US005276487A

United States Patent [19]

Akinaga et al.

[11] Patent Number: 5,276,487

[45] Date of Patent: Jan. 4, 1994

[54] METHOD OF PREVENTING COLORS FROM BEING MIXED FOR A TWO-COLOR IMAGE FORMING APPARATUS

[75] Inventors: Katsuhiro Akinaga; Yasuo Kikuchi; Tomio Sugaya, all of Ibaraki, Japan

[73] Assignee: Hitachi Koki Co., Ltd., Tokyo, Japan

[21] Appl. No.: 875,221

[22] Filed: Apr. 28, 1992

[30] Foreign Application Priority Data

Jul. 29, 1991 [JP] Japan ..... 3-188686

[51] Int. Cl.[5] ..... G03G 13/08

[52] U.S. Cl. ..... 355/245; 355/326; 430/45

[58] Field of Search ..... 355/245, 326, 251; 346/157; 118/645; 430/45

[56] References Cited

U.S. PATENT DOCUMENTS

| | | | |
|---|---|---|---|
| 4,882,247 | 11/1989 | Marugama et al. | 430/45 |
| 4,937,630 | 6/1990 | Yoshikawa et al. | 355/245 X |
| 5,009,973 | 4/1991 | Yoshida et al. | 430/45 |
| 5,036,362 | 7/1991 | Stelter | 355/245 |

FOREIGN PATENT DOCUMENTS

| | | | |
|---|---|---|---|
| 3739255 | 6/1988 | Fed. Rep. of Germany . | |
| 61-203476 | 9/1986 | Japan | 355/326 |
| 63-254474 | 10/1988 | Japan | 355/326 |
| 2-281273 | 11/1990 | Japan | 355/326 |

*Primary Examiner*—Joan H. Pendegrass
*Attorney, Agent, or Firm*—Sughrue, Mion, Zinn, Macpeak & Seas

[57] ABSTRACT

A method of preventing colors from being mixed in a two-color image forming apparatus. The surface of a photoreceptor is uniformly charged. A first latent electrostatic image formed on the photoreceptor surface is developed with a one-component developer so as to form a first toner image. A second latent electrostatic image formed on the photoreceptor surface is developed with a two-component developer so as to form a second toner image. The first and second toner images are simultaneously transferred onto a recording medium. In a preferred embodiment, the one-component developer is a magnetic toner, while the two-component developer is the combination of a nonmagnetic toner and a magnetic carrier. The magnetic toner and the magnetic carrier are preferably powder made of substantially the same materials.

12 Claims, 1 Drawing Sheet

METHOD OF PREVENTING COLORS FROM BEING MIXED FOR A TWO-COLOR IMAGE FORMING APPARATUS

BACKGROUND OF THE INVENTION

1. Field of the Invention

The present invention relates to a method of preventing colors from being mixed in a two-color image forming apparatus wherein a two-color image is formed in a single step of color image formation.

2. Description of the Related Art

A two-color image forming apparatus of the type in which a two-color image is formed in a single step of color image formation is well known. In this type of image forming apparatus, two separate latent electrostatic image forming, and developing stages are used for forming an image having two colors. During latent image forming/developing, the toner used for forming a first toner image in the first latent image forming-/developing stage is inevitably mixed with the toner of the other color for forming a second toner image. As a result, the second toner image contains a mixture of the colors of those toners. This will be described in more detail with reference to FIG. 1.

FIG. 1 is a sectional view showing the construction of a part of a conventional two-color image forming apparatus. As shown, two latent image forming-/developing stages are disposed around a photoreceptor 1 as a drum. The first latent image forming/developing stage A, which forms a first latent electrostatic image and develops it into a first toner image, includes a first charger 2 and a first developing unit 4. A first laser beam 3 containing visual information, such as characters and graphic information, is applied to the charged surface of the photoreceptor 1.

The second latent image forming/developing stage B, which forms a second latent electrostatic image and develops it into a second toner image of a second color different from the first color, is disposed downstream of the first latent image forming/developing stage. This stage includes a second charger 5, and a second developing unit 7. A second laser beam 6 containing a visual information is applied to the charged surface of the photoreceptor 1, after it leaves the second charger 5.

A transfer unit 8 is disposed downstream of the second latent image forming/developing stage. The transfer unit 8 transfers the first and second toner images, which were formed on the surface of the photoreceptor 1 in the first and second latent image forming/developing stages, onto a recording paper 9.

In operation, a first toner image is formed on the surface of the photoreceptor 1 through a process consisting of the following steps:

(1) uniformly charging the surface of the photoreceptor 1 using the first charger 2;

(2) forming a first latent electrostatic image on the surface of the photoreceptor 1 with the first laser beam 3; and (3) developing the first latent electrostatic image with the first developing unit 4.

Similarly, a second toner image is formed on the surface of the photoreceptor 1 through a second process consisting of the following steps:

(1) uniformly charging the surface of the photoreceptor 1 using the second charger 5;

(2) forming a second latent electrostatic image on the surface of the photoreceptor 1 with the second laser beam 6; and (3) developing the second latent electrostatic image with the second developing unit 7.

The first and second toner images thus formed are transferred onto the recording paper 9 by the transfer unit 8.

In the above-described known apparatus for forming an image in two different colors, during the process of forming and developing the first and second latent electrostatic images, the toner forming the first toner image on the surface of the photoreceptor 1 is inevitably partially scraped off the surface of the photoreceptor 1, and enters into the second developing unit 7. In the second developing unit 7, the toner of the first toner image is mixed into the toner of the second toner image, so that the second toner image contains a mixture of the first color (of the first toner) and the second color (of the second toner).

This mixture of the toners also varies the charge properties, e.g., the amount of charge and the polarity of charge, of the second toner. Accordingly, the quality of the resultant reproduced picture is deteriorated. Also, the lifetime of the developer is reduced.

SUMMARY OF THE INVENTION

The present invention has been made in view of the above-mentioned limitations of the conventional devices and has an object to provide a method of preventing colors from being mixed in a two-color image forming apparatus which can reliably prevent the mixing of the color toner for a first toner image with the toner of another color for a second toner image, thereby reproducing an image of high quality.

Another object of the present invention is to provide a method of preventing colors from being mixed in a two-color image forming apparatus which can reliably prevent the mixing of the color toner for a first toner image with the toner of another color for a second toner image, so as to eliminate the variation of the charge properties of the toner of the second image caused by the mixing of the toners.

To achieve these objects, the present invention includes the steps of uniformly charging the surface of a photoreceptor, developing a first latent electrostatic image formed on the photoreceptor surface with a one-component developer so as to form a first toner image, developing a second latent electrostatic image formed on the photoreceptor surface with a two-component developer, so as to form a second toner image, and transferring the first and second toner images onto a recording medium.

If required, the surface of the photoreceptor on which the first latent electrostatic image was formed may be charged again before the second latent electrostatic image is formed thereon.

In a preferred embodiment of the color-mixing preventing method, the one-component developer is a magnetic toner, and the two-component developer is a combination of a nonmagnetic toner and a magnetic carrier. Further, the nonmagnetic toner is preferably made of a material which has little effect on the charge properties of the magnetic toner. Furthermore, the magnetic toner and the magnetic carrier are preferably made of materials which have charge properties that remain essentially constant and are not substantially affected by physical interaction with each other.

BRIEF DESCRIPTION OF THE DRAWINGS

The accompanying drawings, which are incorporated into, and constitute a part of, this specification, illustrate an embodiment of the invention and, together with the description, serve to explain the objects, advantages and principles of the invention. In the drawings.

DETAILED DESCRIPTION OF THE PREFERRED EMBODIMENT

Figure 1:
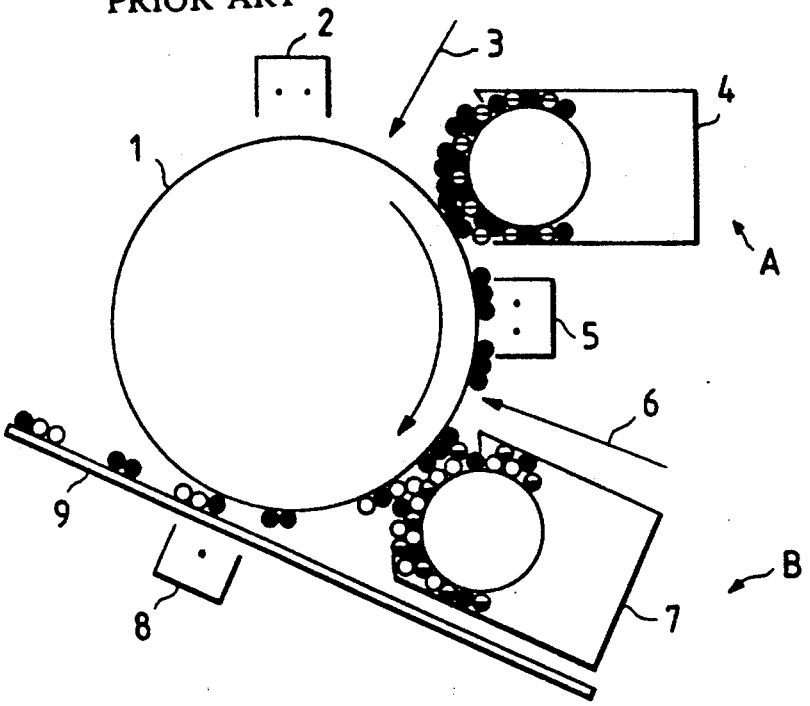
FIG. 1 PRIOR ART
FIG. 1 is a sectional view showing the construction of a conventional two-color image forming apparatus.
Figure 2:
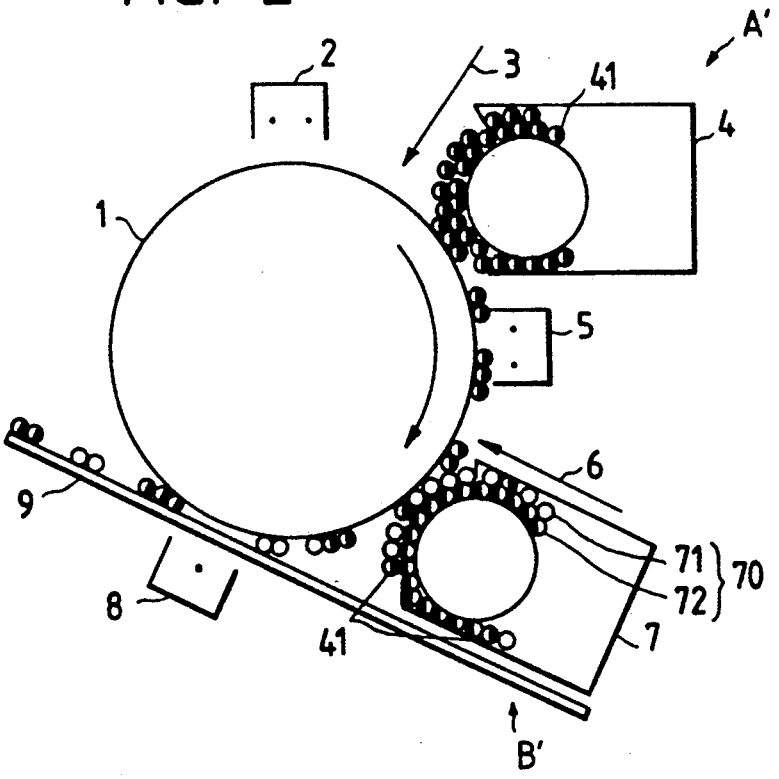
FIG. 2 is a sectional view showing the construction of a two-color image forming apparatus incorporating a method of preventing colors from being mixed according to the preferred embodiment of the present invention.

FIG. 2 is a sectional view showing the construction of a part of a two-color image forming apparatus into which the color-mixing preventing method according to the preferred embodiment of the present invention is incorporated.

In the preferred embodiment, like the conventional image forming apparatus, two latent electrostatic image forming/developing stages are disposed around a photoreceptor 1 which is in the form of a drum. The first latent image forming/developing stage A', which forms a first latent electrostatic image and develops it into a first toner image of a first color, includes a first charger 2 and a first developing unit 4. The first developing unit 4 contains a first developer 41, which is a one-component developer, a magnetic toner in the preferred embodiment. A first laser beam 3 containing visual information, such as characters and graphic information, is applied to the surface of the photoreceptor 1, after it has been charged by the first charger 2.

The second latent image forming/developing stage B', which forms a second latent electrostatic image and develops it into a second toner image of second color which is different from the first color, is disposed downstream of a the first latent image forming/developing stage, and includes a second charger 5 and a second developing unit 7. The second developing unit 7 contains a second developer 70 which is a two-component developer, consisting of, in this embodiment, nonmagnetic toner 71 and magnetic carrier 72. A second laser beam 6 containing visual information is applied to the charged surface of the photoreceptor 1, after is has been charged by the second charger 5.

A transfer unit 8 is disposed downstream of the second latent image forming/developing stage. The transfer unit 8 transfers the first and second toner images, which were formed on the surface of the photoreceptor 1 in the first and second latent image forming/developing stages, onto a recording media 9, such as paper or the like.

As discussed above, in this embodiment, the first developer 41 is a one-component developer, i.e., magnetic toner, and the second developer 70 is two-component developer, i.e., nonmagnetic toner 71 and a magnetic carrier 72. In addition, substantially the same materials are preferably used for both the magnetic toner of the first developer 41 and the magnetic carrier 72 in the second developer. Further, the materials used for making the magnetic toner and the magnetic carrier are preferably selected so that, when the magnetic toner and the carrier are charged by contact electrification, or triboelectrification, or the like, the charge properties, e.g., the amount of charge and the polarity of charge, are not varied significantly. Furthermore, the nonmagnetic toner 71 in the second developer is preferably made of a material which has little influence on the charge properties of the magnetic toner of the first developer.

In operation, a first toner image is formed on the surface of the photoreceptor 1 through the following steps:

(1) uniformly forming a charge on the surface of the photoreceptor 1 by the first charger 2;

(2) forming a first latent electrostatic image on the surface of the photoreceptor 1 with the first laser beam 3; and (3) developing the first latent electrostatic image using the first developing unit 4.

Similarly, a second toner image is formed on the surface of the photoreceptor 1 through the following steps:

(1) uniformly forming a charge on the surface of the photoreceptor 1 by the second charger 5;

(2) forming a second latent electrostatic image on the surface of the photoreceptor 1 with the second laser beam 6; and (3) developing the second latent electrostatic image by the second developing unit 7.

The first and second toner images thus formed are then simultaneously transferred onto the recording media 9 by the transfer unit 8.

During the course of the developing step by the second developing unit 7, a small quantity of first developer 41 is scraped off of the first toner image and enters the second developing unit 7. In the second developing unit 7, the magnetic toner 41 is mixed with the second developer 70 and serves as the carrier in the second developer 70 because the mixed magnetic toner 41 and the magnetic carrier 72 originally contained in the second developer 70 are made of substantially the same material.

Further, the nonmagnetic toner 71 in the second developer 70 is made of a material which has little influence on the charge properties of the carriers including the mixed magnetic toner 41. Therefore, the mixed carriers 41 and 72 stably charge the nonmagnetic toner 71. Consequently, the second latent image formed by the second laser beam 6 is stably developed by the second developer 70 even if the developer 70 is mixed with the magnetic toner 41 of the first developer.

Additionally, it is noted that since the toner 41 mixed into the second developer 70 is magnetic in physical nature, it magnetically interacts with the magnetic roll (not shown). For this reason, only the nonmagnetic toner 71 contributes to the development of the second latent electrostatic image. This further ensures a further reliable color-mixing prevention effect.

In the preferred embodiment of the present invention described above, a recharging step is contained in the two-color latent image forming/developing process. It is evident, however, that the method of preventing colors from being mixed according to the present invention is applicable for a two-color image forming apparatus which does not include a recharging step.

The foregoing description of the preferred embodiment of the invention has been presented for purposes of illustration and description. It is not intended to be exhaustive or to limit the invention to the precise form disclosed. In fact, modifications and variations are possible in light of the above teachings or may be acquired from practice of the invention as disclosed. The embodiment was chosen and described in order to explain the principles of the invention and its practical application to enable one skilled in the art to utilize the invention in various embodiments and with various modifications as are suited to the particular use contemplated. Accordingly, it is intended that the scope of the invention be defined by the claims appended hereto, and their equivalents.

What is claimed is:

1. A method of preventing colors from being mixed in a tow-color image forming apparatus, said method comprising the steps of:

uniformly charging the surface of a photoreceptor;

developing a first latent electrostatic image formed on said photoreceptor surface with a one-component developer, so as to form a first toner image;

developing a second latent electrostatic image formed on said photoreceptor surface with a two-component developer, so as to form a second toner image; and transferring said first and second toner image onto a recording medium, wherein said one-component developer comprises a magnetic toner, and said two-component developer comprises a combination of a nonmagnetic toner and a magnetic carrier, and wherein said nonmagnetic toner comprises a material which does not substantially affect the charge properties of said magnetic toner.

2. The method according to claim 1, in which said magnetic toner and said magnetic carrie comprise material whose charge properties are not substantially varied due to physical interaction therebetween when said magnetic toner and said magnetic carrier are mixed.

3. The method according to claim 1 wherein said magnetic toner and said magnetic carrier each comprise substantially the same materials.

4. The method according to claim 1 further comprising a second step of uniformly charging the surface of said photoreceptor between the step of developing the first latent electrostatic image and the step of developing the second latent electrostatic image.

5. The method according to claim 1, further comprising a step of applying an optical beam containing visual information to the charged surface of said photoreceptor, said applying step being performed between the charging step and the step of developing the first latent electrostatic image.

6. The method according to claim 5, further comprising a step of applying a second optical beam containing visual information to the surface of said photoreceptor, said second applying step being performed between the step of developing the first latent electrostatic image and the step of developing the second latent electrostatic image.

7. The method according to claim 1, further comprising a step of applying an optical beam containing visual information to the charged surface of said photoreceptor.

8. The method according to claim 1, further comprising a step of applying a second optical beam containing visual information to the surface of said photoreceptor.

9. A method of preventing colors from being mixed in a two-color image forming apparatus, said method comprising the steps of:

uniformly charging the surface of a photoreceptor;

developing a first latent electrostatic image formed on the photoreceptor surface with a one-component developer so as to form a first toner image;

uniformly recharging the surface of said photoreceptor bearing the first toner image thereon;

developing a second latent electrostatic image formed on said photoreceptor surface with a two-component developer so as to form a second toner image; and transferring said first and second toner image onto a recording medium, wherein said one-component developer comprises a magnetic toner, and said two-component developer comprises a combination of a nonmagnetic toner and a magnetic carrier, and wherein said nonmagnetic toner comprises a material which does not substantially affect the charge properties of said magnetic toner.

10. The method according to claim 9, wherein said magnetic toner and said magnetic carrier comprise substantially the same materials.

11. A method of preventing colors from being mixed in a two-color image forming apparatus, said method comprising the steps of:

uniformly charging the surface of a photoreceptor;

developing a first latent electrostatic image formed on the photoreceptor surface with a one-component developer so as to form a first toner image;

uniformly recharging the surface of said photoreceptor bearing the first toner thereon;

developing a second latent electrostatic image formed on said photoreceptor surface with a two-component developer so as to form a second toner image; and transferring said first and second toner image onto a recording medium, wherein said one-component developer comprises a magnetic toner, and said two-component developer comprises a combination of a nonmagnetic toner and a magnetic carrier and wherein said magnetic toner and said magnetic carrier comprise material whose charge properties are not substantially varied due to physical interaction therebetween when said magnetic toner and said magnetic carrier are mixed.

12. A method of preventing colors from being mixed in a two-color image forming apparatus, said method comprising the steps of:

uniformly charging the surface of photoreceptor;

developing a first latent electrostatic image formed on the photoreceptor surface with a one-component developer so as to form a first toner image;

developing a second latent electrostatic image formed on said photoreceptor surface with a two-component developer so as to form a second toner image; and transferring said first and second toner image onto a recording medium, wherein said one-component developer comprises a magnetic toner, and said two-component developer comprises a combination of a nonmagnetic toner and a magnetic carrier, in which said magnetic toner and said magnetic carrier comprise materials whose charge properties are not substantially varied due to physical interaction therebetween when said magnetic toner and said magnetic carrier are mixed.

* * * * *